US005417382A

United States Patent [19]

Petitjean et al.

[11] Patent Number: 5,417,382

[45] Date of Patent: May 23, 1995

[54] METHOD AND APPARATUS FOR WINDING A WEB

[75] Inventors: Gilles Petitjean, Arlon, Belgium; Nicolas Rollinger, Bettembourg, Luxembourg; Bert Van Den Bedem, Schuttrange, Luxembourg; Jean-Luc Verheggen, Kleinbettingen, Luxembourg

[73] Assignee: E. I. Du Pont de Nemours and Company, Wilmington, Del.

[21] Appl. No.: 161,688

[22] Filed: Dec. 2, 1993

Related U.S. Application Data

[63] Continuation of Ser. No. 856,295, Mar. 23, 1992, abandoned.

[51] Int. Cl.[6] ..... B65H 19/26

[52] U.S. Cl. ..... 242/527; 242/527.3

[58] Field of Search ..... 242/56 A, 56.2, 56.4, 242/56.5, 56.7, 64, 526, 527, 527.2, 527.3

[56] References Cited

U.S. PATENT DOCUMENTS

| | | | |
|---|---|---|---|
| 3,144,216 | 8/1964 | Billingsley | 242/56.5 |
| 3,345,009 | 10/1967 | Rockstrom | 242/56 A |
| 3,536,273 | 10/1970 | Hawkins | 242/56.7 |
| 3,630,462 | 12/1971 | Nordgren et al. | 242/56 A X |
| 3,756,527 | 9/1973 | Collins et al. | 242/56.2 |
| 3,794,256 | 2/1974 | Schwarz | 242/56 A |
| 3,858,285 | 1/1975 | Williams | 242/56.1 |
| 3,871,290 | 3/1975 | Verboom | 242/56.2 X |
| 4,040,574 | 8/1977 | Johnson | 242/56 A |
| 4,171,780 | 10/1979 | Bugnone | 242/56 A |
| 4,193,559 | 3/1980 | Ballard | 242/67.1 R |
| 4,208,019 | 6/1980 | Dusenbery | 242/56 A |
| 4,265,409 | 5/1981 | Cox et al. | 242/56 A |
| 4,431,140 | 2/1984 | Tetro | 242/56 A |
| 4,611,769 | 9/1986 | Orbach | 242/56 A X |
| 4,770,358 | 9/1988 | Suzuki et al. | 242/56 A |

*Primary Examiner*—John P. Darling

[57] ABSTRACT

Apparatus for automatic high-speed winding of a continuous web of thin film-like material onto a core to form a wound roll, in which the film is applied by a train of idling lay-on rolls consisting of first and second rolls arranged parallel to the said core and which, in the production position are applied against the roll being wound by use of a pneumatic cylinder having a movable piston situated at each end of each roll and each acting on a respective pivoting arm one end of which carries a bearing on which the rolls are journaled and the other end of which pivots on a carriage that can be advanced and retracted along a guide path, enabling perfectly uniform wound rolls to be obtained.

24 Claims, 5 Drawing Sheets

FIG.4
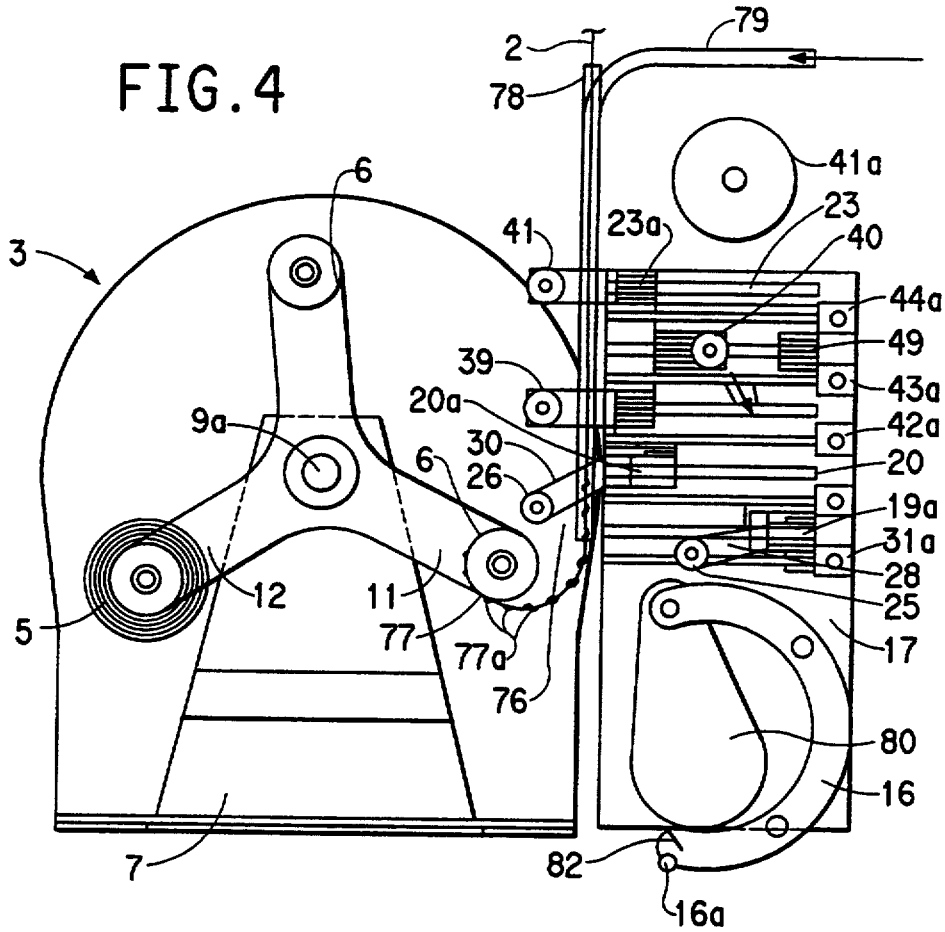
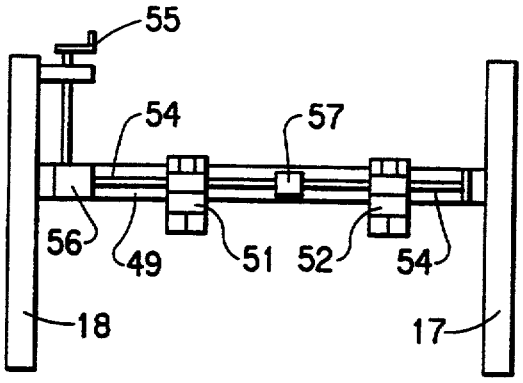
FIG.5
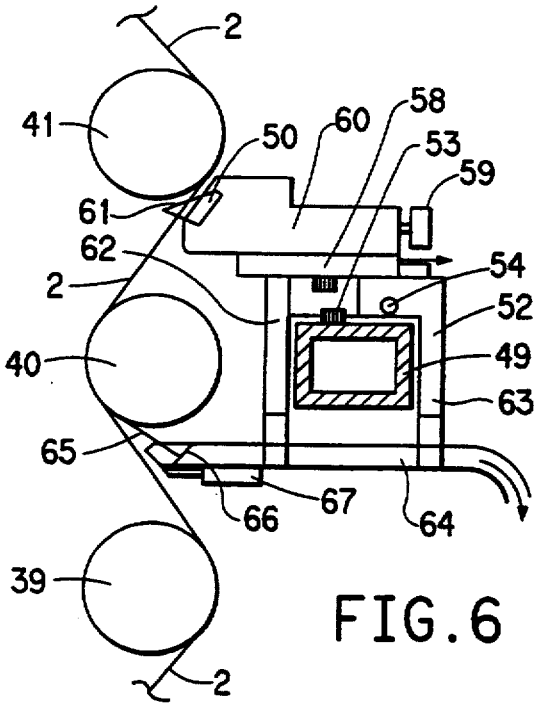
FIG.6

METHOD AND APPARATUS FOR WINDING A WEB

This is a continuation of application Ser. No. 07/856,295 filed Mar. 23, 1992, now abandoned.

BACKGROUND OF THE INVENTION

This invention relates to an apparatus for winding a continuous web of film material onto a core driven in rotation by a spindle and onto which said web of film is wound in order to form a cylindrical wound roll by means of a train of lay-on rolls for applying said web to a said core, said train comprising first and second idling rolls arranged parallel to said core the first of said rolls being partially surrounded, during winding of said core, by said web and being disposed tangentially with respect to said second roll while firmly pressing said web against the surface thereof, and with respect to the outer surface of the wound roll to which said film is applied.

Very numerous winding devices are known in the art, such apparatus being used for winding thin webs of materials such as paper, plastic material which are supplied to users in roll form wound onto cylindrical cores which are generally of cardboard. When extremely thin webs are involved in which the material is generally in the form of film or film-like material of a resilient and deformable material such as plastics, it is extremely difficult to achieve regular winding of successive layers the outer surface of which are only truly flat when the film is under tension. Inspection with the naked eye of rolls of such film always reveals the presence of irregularities produced during winding.

Additionally, there is also a need to wind certain plastic materials that have been processed to form thin tear-resistant films into a roll that can be used directly and which is hence brought to the appropriate width after leaving the plastic material film production line.

One of the objects of this invention is hence to provide winding apparatus for a strip of film material for use directly following the material production line and which enables a regularly-wound roll of film to be obtained, in which the winding operations can be initiated and monitored automatically through the use of controlled-pressure lay-on rolls which faithfully follow the growth in diameter of the winding roll in order to achieve regular application of the film onto the outer surface of the winding roll, and which can additionally be regulated in position and withdrawn.

Another object of the present invention is to provide apparatus enabling slit rolls of thin film material to be obtained in a continuous production process through the use of winding apparatus which is highly accurate, robust and ensures that completely reproducible and reliable operation of all its component parts are obtained, leading to a significant reduction in maintenance downtime.

A further object is to increase productions speeds and particularly speed up the operations of thread-up and change of winding from one roll to another while simultaneously obtaining higher product yields and quality.

It is a further objects of the invention to provide winding apparatus which includes a set of feed rolls that cooperate with means for cutting the film and bring it to the appropriate width ahead of the lay-on rolls as well as suitable means for evacuating offcuts after cutting.

A further aim of the invention is to provide a winding method using apparatus which enables the start of winding as well as changeover from one film roll to another to be achieved automatically.

SUMMARY OF THE INVENTION

In accordance to the invention, apparatus is provided for winding a continuous web of film material onto a core driven in rotation by a spindle and onto which said web of film is wound in order to form a cylindrical wound roll by means of a train of lay-on rolls for applying said web to a said core, said train comprising first and second idling rolls arranged parallel to said core the first of said rolls being partially surrounded, during winding of said core, by said web and being disposed tangentially with respect to said second roll while firmly pressing said web against the surface thereof, and with respect to the outer surface of the wound roll to which said film is applied wherein, in the winding position, said first and second rolls are respectively applied to the outer surface of said wound roll being formed on said core and to said first roll by separate urging means located at each end of each roll and each acting on a respective pivoting arm one end of which carries a bearing allowing rotation of a roll mounted therein and the other end of which pivots on a carriage movable along a guiding surface, said guiding surfaces of each of said rolls being mutually parallel and the movements of the two carriages of a roll being synchronized by mechanical synchronization means linking said two carriages.

According to one feature, each of said urging means is adapted to act on the corresponding pivoting arm in order to resiliently bias it to a position of maximum angle of swing when said first or second rolls are not subject to the respective reaction forces respectively provided by said wound roll and by said first lay-on roll.

According to another feature, the urging means consists of a pneumatic cylinder having a piston movable therein the rod of said piston pivoting on an extension of said pivoting arm while the other end of said pneumatic cylinder remote from said rod pivots on the corresponding carriage.

According to a further feature of the invention, in the position corresponding to thread up or initiation of winding, the carriages of said first cylinder are adapted to be displaced away from said cylindrical roll to a retracted position at which said first lay-on roll is no longer in contact with said second lay-on roll and with the outer surface of said cylindrical roll whereby a passage between said first and second lay-on rolls in created for allowing introduction of the leader of the film to be wound. The carriages of the second said lay-on roll are adapted to be held in position while their pivoting arms are caused to pivot to a position of maximum allowable swing by said urging means.

According to another feature, where said apparatus includes several cores each arranged on one of the arms of a rotatable turret means, the carriages of said first and said second lay-on rolls are adapted to move along their guiding surfaces to a retracted position remote from said wound roll to allow the arms, carrying a said wound roll or core, of said turret to rotate.

According to a further feature of the apparatus for winding a web of film, said apparatus includes, applied to said continuous web of film ahead, considered in the direction of advancement of said web, of said first and second lay-on rolls, a train of web feeding and slitting rolls. Said train of web feeding and slitting rolls comprises a third roll providing transfer to said second lay-on roll, a fourth roll for tensioning said continuous web of film during cutting and a fifth roll for stabilizing and maintaining the web of film during cutting thereof, said third, fourth and fifth rolls being parallely placed, in the production position of said apparatus, in a position where they are substantially vertically aligned one above the other and mutually spaced, said web of film being wound, prior to engaging said second lay-on roll, partially over said web-feeding rolls in alternate directions from one roll to the next. At least one knife means is applied to said web of film stretched between said fourth and fifth rolls.

According to yet another feature, the end bearings of the third, fourth and fifth rolls are each carried by a carriage movable along a substantially horizontal guiding surface arranged laterally with respect to said wound roll of film, the two carriages for each roll being synchronized by mechanical synchronizing means and being adapted to be movable, at least as regards said third and fifth rolls, from a position where they are advanced towards said wound roll of film to a retracted position.

According to a further feature of the invention, in the position corresponding to thread-up or initiation of winding, the carriages of said third and fifth rolls are movable along their guiding surfaces in order to approach said wound roll to a fully-advanced position that provides a passage between said advanced third and fifth rolls, and said fourth roll, allowing introduction of the leader of the film to be wound.

According to another feature, the five said rolls comprising the two said lay-on rolls and the three said web-feeding rolls have substantially the same length and wherein the guiding surfaces for the carriages of said five rolls are supported by two parallel vertical plates arranged at a spacing substantially corresponding to the length of said rolls. Said two parallel vertical plates carry a beam arranged parallel to said rolls and at the same level as said fourth roll and at the opposite side thereto to said wound roll of film, said hollow beam carrying at the upper portion thereof a knife means mounted on a movable carrier the position of which can be adjusted both in the direction parallel to the axis of said beam and in the direction perpendicular thereto and wherein said knife means is applied to said film stretched between said fourth and fifth rolls in the region of said fifth roll. Said beam carries at least one tube for collecting the strip of trim cut from said continuous web of film by said knife means. Said trim collecting tube is carried substantially horizontally below said beam, said tube having an inlet for said trim in the form of a mouthpiece that opens below said fourth roll. Said tube can include chopping means for said trim after introduction thereof into said tube.

According to yet a further feature, the extreme positions of the carriages of said first, second, third, fourth and fifth rolls on their respective guiding surfaces are adjustable manually by moving the position of a stop means cooperating with means for generating an electrical signal for controlling a drive motor for providing synchronized displacement of the two carriages of each said roll. Mechanical synchronizing means for the two carriages of each of said first, second, third, fourth and fifth rolls include mechanical synchronization interrupting means adapted to enable the position one of said two carriages connected to said synchronizing means to be adjusted independently of the other. The first roll is covered with an elastomeric material, while the second roll is a highly-rigid solid roll having a chrome plated finish and said third, fourth and fifth rolls are in aluminum with a black anodized finish.

The invention also provides a method for winding a continuous web of film material onto a core driven in rotation by a spindle and onto which said web is wound in order to constitute a cylindrical wound roll by means of a train of lay-on film application rolls consisting of first and second rolls pressing said web of film partially wound around said first roll respectively against the outer surface of said wound roll and against said first roll, each one of the end bearings of the first and second rolls are mounted on a pivoting arm carried by a carriage movable on a guiding surface and the movements of the two carriages of each roll being synchronized, each of said arms is acted on by individual urging means to cause pivoting thereof whereby said first roll is urged against said wound roll of film and said second roll is urged against said first roll, and in order to introduce said web onto said core prior to said winding operation, the two carriages of said first roll are retracted on their guiding surfaces away from said core in order to establish a passage between said first and second rolls through which the end of said web of film to be wound is introduced and wherein before the start of winding, the said carriages are returned to their starting positions in order to press said web of film against said wound roll and onto said first roll. With several cores being each arranged on one arm of a revolving turret, prior to rotation of said turret, the carriages of said first and second rolls are retracted on their guiding surfaces in order to move them away from said roll of film to provide a free passage for an arm loaded with a core or a wound roll of film of said turret.

According to another feature of the method for winding a web of film in which onto said web of film, a train of web feed and guiding rolls over which said web passes in alternate directions is provided ahead of said lay-on film application rolls, each one of the end bearings of at least one of two alternate of said web feed and guiding rolls is mounted on a movable carriage moving linearly on a guiding surface in mechanical synchronization with the other of the two carriages of each of said rolls, said alternate individual rolls being displaced through moving of the carriages thereof on said guiding surfaces in order to bring them close to said wound roll of film and to open up a passage between said alternate rolls through which the leader end of a web to be wound is introduced and wherein, after the start of winding, said carriages are returned to their starting position in order to bring said web of film into contact with said feed and guiding rolls.

Other subjects, features and advantages of the invention will become more clear from the description that follows of various embodiments of the invention, provided by way of non-limiting examples and with reference to the attached drawings.

BRIEF DESCRIPTION OF THE DRAWINGS

In the drawings:

FIG. 4 is a schematic side view of the apparatus similar to FIG. 1 but on a slightly reduced scale and illustrating the position of the various parts during initial thread-up.

FIG. 5 is a rear view showing the film cutting or slitting arrangements of the apparatus in FIG. 1.

FIG. 6 is a more detailed side view on a larger scale of part of FIG. 5 showing the film slitting and trim or offcut removal means of the apparatus in FIG. 1, as well as the position of these means with respect to the three upper transfer rolls of the apparatus.

DETAILED DESCRIPTION OF PREFERRED EMBODIMENTS

Figure 1:
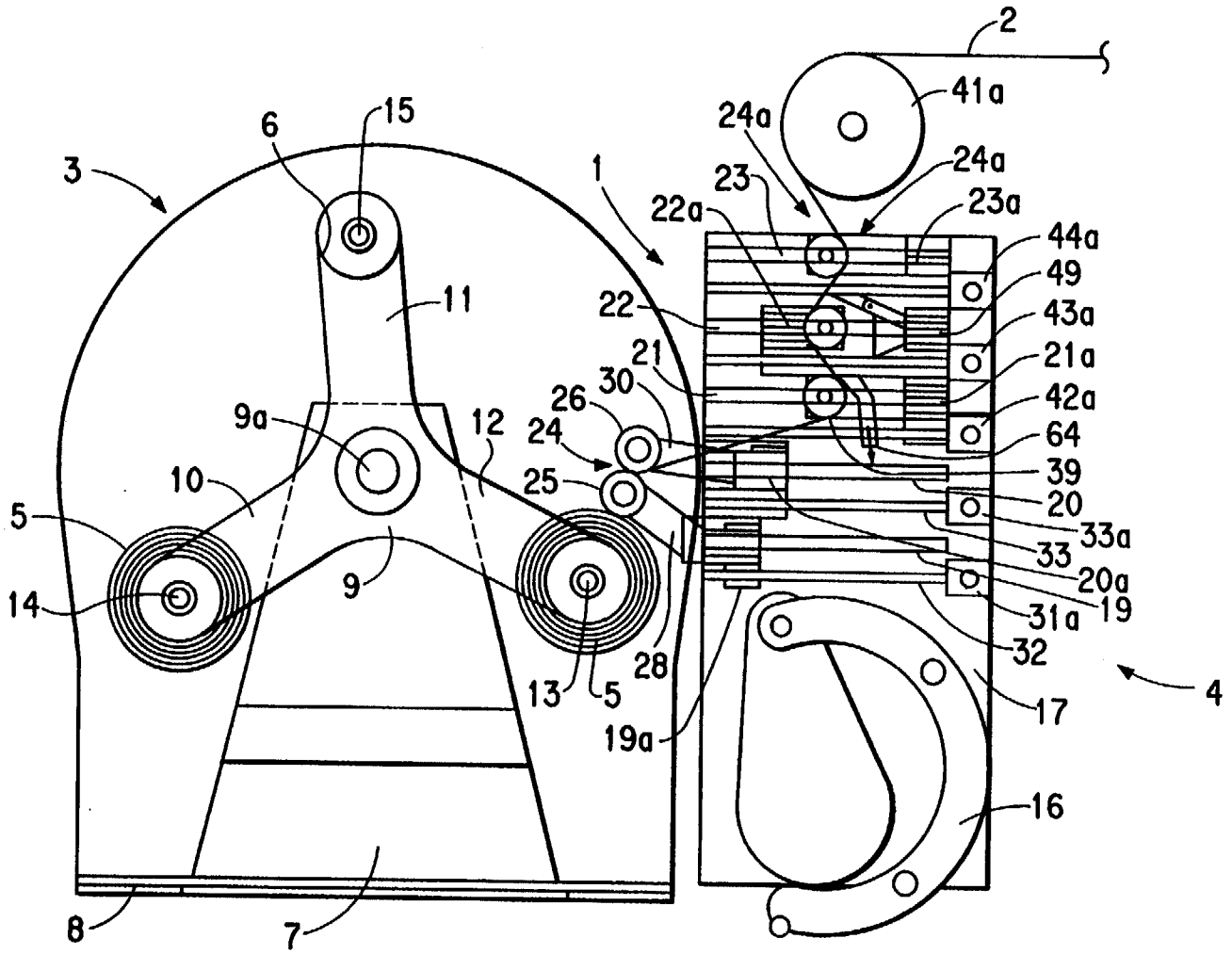
FIG. 1 is a schematic side view illustrating the winding apparatus of the invention in the normal production position, in other words in the process of winding film onto a core to form a roll.

With reference to FIG. 1 which is a side view of the complete winding apparatus 1 for a strip of film 2 of a material suitable for forming thin or extremely thin strips of film, such as polyester plastic material film, it will be seen that the winding apparatus consists essentially of a turret assembly 3 and an assembly 4 for supporting the various rolls that feed and apply the film 2, and trim it to the appropriate width. The turret 3 carries an assembly 9 of indexed arms 10, 11 and 12 onto which empty cores 6, generally made of cardboard, can be fitted. A core 6 is driven in rotation by rotating the appropriate spindle, here spindle 13, by driving means which are not shown, for winding a film wound roll 5. Arm 11 is carrying an empty core 6 on its spindle 15, the core on arm 12 is being wound and arm 10 is carrying on its spindle 14 a wound roll 5 that is ready for removal of the turret will be referred to by the term "wound roll" regardless of whether winding is finished, only starting, or in progress.

The turret assembly 3 further comprises a frame 7 secured to a baseplate 8 carrying the set 9 of arms 10, 11, 12 distributed regularly around a support axis 9*a* secured to frame 7. The set 9 of arms can rotate around axis 9*a* in order to move the rolls 5 from a winding position on spindle 13 to an unloading position on spindle 14. After removal of a roll 5, a new core 6 can be mounted on arm 10. Considering the case of a turret with three arms 10, 11, 12, arm 10 will move to an upper standby position 11 after rotating about axis 9*a*. Obviously, it would be possible to use a turret assembly 3 having two diametrically opposing active arms, or even provided with more than three arms.

The winding apparatus also includes an arcuate enveloper roll arm system 16 which cooperates in automatic roll winding changeover and film cutting, and details of its operation will be given below.

Figure 2:
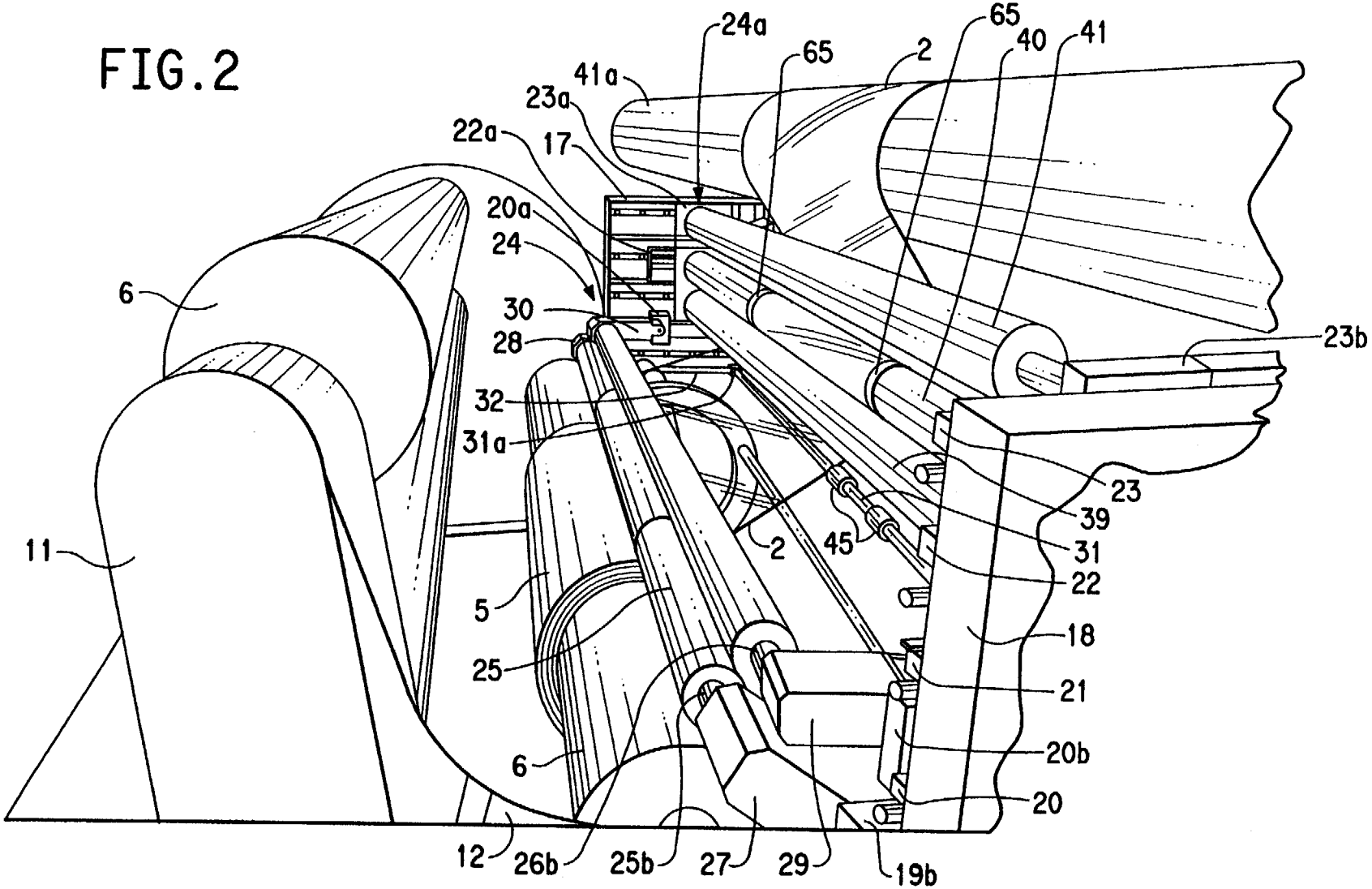
FIG. 2 is an end view in perspective of part of the apparatus of FIG. 1.

The assembly 4 for supporting the various rolls that feed and apply the film 2 is supported by two parallel vertical columns or plates 17 and 18 which are essentially similar in design—only column 17 is shown in FIG. 1, both being shown in FIG. 2—which are mounted on a baseplate and maintained at a determined spacing, essentially dictated by the width of the film to be wound, by cross members which are not shown. The upper top half of the plates 17 and 18 carry guiding surfaces formed by horizontal linear guides 19, 20, 21, 22, 23 along which corresponding carriages in the form of carriages 19*a* to 23*a* and 19*b* to 23*b* carried in the linear guides of the respective plates 17 and 19 are able to roll or slide.

Each one of the sliding carriers is fitted with an end bearing means for one of the transfer rolls for the strip of film. As shown in FIG. 1, these transfer rolls can be considered as constituting two trains or sets the functions of which are generally different. A dual tracking lay-on roll train or gear 24 consists of a first actual lay-on roll 25 consisting, for example, of a hollow metal tube provided with an elastomer covering on its outer surface and which, in the production, far-forward winding position shown in FIG. 1, is surrounded over about 180° of its surface by the strip of film 2 and is applied tangentially along a parallel line (actually a narrow strip) onto the outer surface of the roll 5, or of the core 6, at the start of winding. The dual tracking roll train 24 includes a second roll 26 providing tracking which is applied tangentially to the first roll 25 and which, for example, consists of a highly rigid roller which is chrome plated on its outer surface to resist abrasion and to provide optimum film spreading.

Rolls 25 and 26 rotate idly, i.e., non-driven, on their corresponding end bearings. In FIG. 2, it can be seen how the end portions 25*b* and 26*b* of these two rolls are journaled in these end bearings at one of the ends of the rolls; the bearing ends 28*a* and 30*a* of the two rolls can be seen in FIG. 3. The end bearings of rolls 25 and 26 are not directly carried by the sliding carriers supported on the linear guides but rather via pivoting arms 27 to 30 one end of which carried a bearing for a roll (roll 25 being carried by arms 27 and 28 and roll 26 by arms 29 and 30) the other end of which pivots on one of the sliding carriers (19*a* and 19*b* for arms 27 and 28 and 20*a* and 20*b* for arms 29 and 30).

In order to ensure correct guiding of rolls 25 and 26, the two sliding carriers of a given roll being movable along two corresponding linear guides 19 and 20, these guides are arranged parallel to each other on the two vertical plates 17 and 18. These sliding carriers that support the arms are advanced and retracted while sliding along their relevant linear guides, by lead screws running parallel to the linear guides, rotation of which causes the carriers to advance or retreat. In order to ensure the axes of the two rolls 25 and 26 are constantly kept parallel to each other and to the winding spindle (winding spindle 5, core 6, and their support arms 13, 14, 15), displacement of the two sliding carriers of a given cylinder are mechanically synchronized by synchronizing means that link two sliding carriers. The synchronizing means are, for example, constituted for sliding carriers 19*a* and 19*b* of roll 25, by a synchronization shaft 31 running between the two vertical plates 17 and 18 for connected two bevel-gear gearboxes 31*a* and 31b (only gearbox 31*a* can be seen in FIGS. 1 and 2) linked mechanically by gearing means or the like to the corresponding lead screw (32 for gearbox 31*a*) that displaces the sliding carrier 19*a* (or 19*b* at the other end). Screw 32, while is generally constituted by a low friction ball screw, is arranged strictly parallel to the linear guide 19. For sliding carrier 20*a*, FIG. 1 shows the gearbox 33*a* mechanically linked to a lead screw 33 parallel to linear guide 20.

The rolls 25 and 26 are biased by their corresponding pivoting arms 27, 28 and 29, 30 for applying them respectively onto roll 5 and roll 25 as a result of swinging of the pivoting arms in the clockwise direction by the application of force from urging means which can consist of springs. In order to obtain a substantially constant loading on the rolls 25 and 26, the urging means for each arm shown in FIG. 3 consist of a pneumatic actuator 34 or 35 consisting of a piston moving in a cylinder between extreme abutment positions and integral with a piston rod 36, 37 projecting externally. In the embodiment shown in FIG. 3, each actuator pivots at one end of its cylindrical body, for example at 35*a* for actuator 35, on the corresponding sliding carrier (here sliding carrier 20*a*) which supports it while its piston rod 36 or 37 pivots by means of a forked arm and a pivot pin (at 37*a* on an extension 38 of arm 30 for actuator 35). It will be seen that the piston and the piston rod are only able to have a limited stroke when the piston is at the bottom of the cylinder of the actuator whereby, as soon as the first and/or second roll(s) cease to be in contact with their corresponding supporting roll (the roll 5 in the process of being wound or lay-on roll 25) it comes to a stop position without contact, being maintained by its piston.

A second train of rolls 24*a* providing an S-shaped path for film transfer and spreading before and after slitting, is provided ahead of the dual tracking lay-on roll train and consists of three rolls which, in the winding position shown in FIG. 1, lay substantially one on top of the other and mutually spaced from each other. The length of the span of web between each of these rolls has been found to give the best results when this length is less than one-quarter of the width of the film, and is preferably one-eighth of this width. The roll train consists of a third roll 39 providing transfer to the second roll 26 and having a smooth surface, for example, in black anodized aluminum, for ensuring good adherence to the strip of film 2. This third roll 39 is mounted idle on two end bearings each one of which is carried by a respective carriage such as a sliding carrier 21*a* and 21*b* sliding in a guiding surface such as linear guides 21. The strip of film 2 passes over a portion of the surface of this third roll 39 in the same direction as over the second roll 26.

The third roll 39 is preceded, with respect to the direction of advance of film 2, by a fourth roll 40 the function of which is to ensure film spreading and transfer following trim slitting of the film. This fourth roll 40 is also employed for measurement of the film tension, the bearings thereof being mounted at each side in suitable tension measuring cells, such as a load cell, in order to provide a signal to a tension control module. The roll 40 is mounted idle in the said bearings each one of which is fitted onto a respective sliding carrier 22*a* and 22*b* which slides in linear guides 22. The strip of film 2 passes over this fourth roll 40 in the opposite direction to that of the third and second rolls 39 and 26, and in the same direction as over the first roll 25.

The fourth roll 40 is preceded by a fifth roll 41 the function of which is to spread the film and stabilize it prior to trim slitting. This fifth roll is mounted idle on two end bearings each one of which is housed by the respective sliding carrier 23*a* and 23*b* moving in linear guides 23. The strip of film 2 is wrapped around this fifth roll 41 in the same direction as over rolls 26 and 39 after leaving a feed roll 41*a* of larger diameter than the five rolls for film feeding and applying strip 2 before its winding onto roll of film 5.

Figure 3:
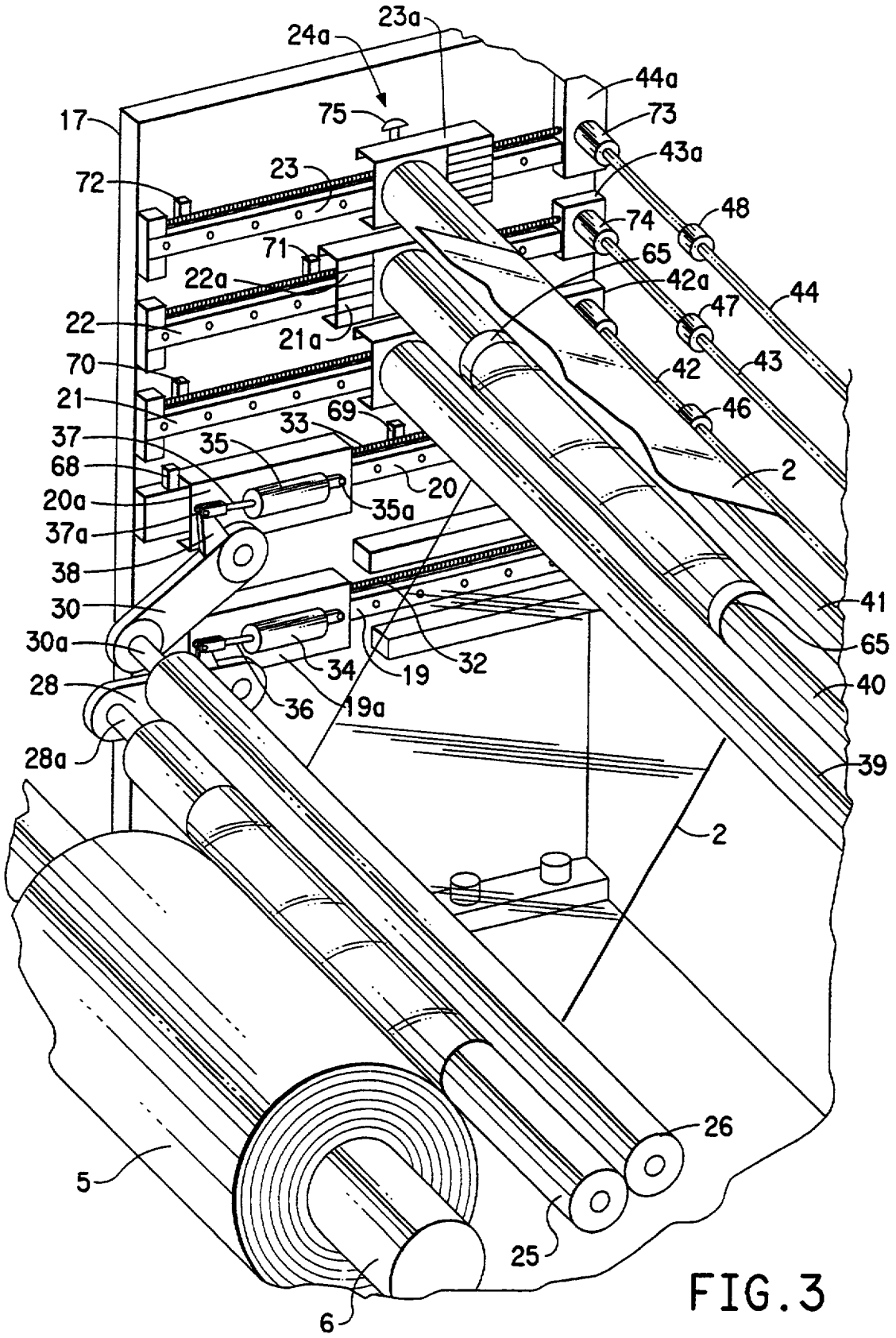
FIG. 3 is a perspective view similar to FIG. 2 but viewed from inside and closer to the far end thereof and from a slightly different angle enabling the roll driving and guiding mechanisms to be seen in greater detail.

The two sliding carriers of each one of rolls 39, 40, 41 of this second S-shaped roll train can move horizontally in parallel linear guides with synchronized movements, just like those of the two dual tracking rolls 25 and 26 of the first roll train. This synchronization means for the two sliding carriers of a given roll consist, as already described for roll 25, of a synchronizing shaft which links (see synchronizing shafts 42, 43, 44 corresponding to rolls 39, 40 and 41 respectively) two gearboxes each mounted on one of the vertical plates 17 or 18, the gearboxes being linked by means of a rotating lead screw to the corresponding sliding carriers. In FIGS. 1 and 3, gearboxes 42*a*, 43*a* and 44*a* have been shown mounted on vertical plate 17 and respectively corresponding to synchronizing shafts 42, 43 and 44. In order to enable the starting position of a sliding carrier to be individually adjusted, synchronizing shafts 42 to 44 together with the synchronizing shafts of the first two rolls 25 and 26, are provided with a mechanical means for interrupting synchronization, these, for example, consisting of a double threaded sleeve which joins two portions of a synchronizing shaft. In FIGS. 1 and 3, such sleeves 45, 46, 47 and 48 are illustrated these being respectively provided on synchronizing shafts 31, 42, 43, 44. Such a sleeve can be rotated together with one single portion of a synchronizing shaft and then once again locked with respect to the other portion of the shaft in order to enable one of the roll sliding carriers to be shifted with respect to the other sliding carrier, and then, after the sleeve has been locked onto the synchronizing shaft, to ensure synchronized movement of the two sliding carriers of a given roll.

It will be noticed in FIG. 1 that sliding carrier 22*a* which incorporates one of the bearings of the fourth roll 40 faces the turret 3 carrying the wound rolls 5 rather than being directed away therefrom. This reverse arrangement of sliding carrier 22*a* (and of sliding carrier 22*b* which is not illustrated) comes about due to the fact that sliding carrier 22*a* only moves by small amounts, mainly for adjustment purposes, unlike the other sliding carriers, and also as a result of the fact that it is necessary to house a hollow beam 49 of relatively large diameter, arranged in the transverse sense between vertical plates 17 and 18, behind the fourth roll 40. The purpose of this hollow beam 49 is discussed in detail below. Before leaving the roll mounting arrangements, it should be mentioned that movement of the roll sliding carriers can be achieved by the use of stepping electric motors or dual-speed pneumatic motors coupled to the above said gearboxes, in which, after movement of a roll, the air feed is interrupted and the sliding carriers are maintained in place by a brake mounted on the pneumatic motor or by an irreversible transmission system.

The hollow beam 49 is used to support one or several knifes or cutting elements 50, these being employed to slit the film 2, and are illustrated in FIGS. 5 and 6 in rear and cross-sectional views on differing scales. In FIG. 5, the hollow beam 49 can be seen linking the two vertical plates 17, and 18, this carrying for, for example, two movable cutting carriages 51 and 52 which can move by rolling on rollers 53 at the upper portion of beam 49 through rotation of a displacing and adjusting screw 54 which is parallel to the beam 49 and can consist of two coupled halves, one of which is left-threaded and the other right-threaded. This screw 54 can be caused to rotate manually by turning an adjustment handle 55 which acts mechanically on the screw 54 through a gearbox 56. Like for the lead screws of the sliding carriers, each of the cutting carriages 51 or 52 can be moved, through a desynchronization sleeve 57, independently of the other for adjustment purposes, the corresponding knives normally being set to remove a trim or offcut at the two sides of the advancing web.

With reference to FIG. 6, this shows the cutting carriage 52 carrying an upper sliding guide 58 on which a knife sliding carrier 60 is able to move transversally to the longitudinal axis of beam 49 by means of moving means such as a handle 59 in order to bring the cutting edge 61 of the relevant knife 50 into contact with the film 2 which is tensioned between the fourth cylinder 40 and the fifth cylinder 41. The knife sliding carrier is advanced or retracted by a short-stroke pneumatic table for the purpose of entering and withdrawing the knife 50 from the film 2. The knife holder can be retracted from the rear of the apparatus well away from the film winding mechanisms, allowing it to be replaced without disturbing the winding setup.

Each knife holder 51 or 52 carries, via uprights 62 and 63 which surround beam section 49, a tube 64 for collecting an offcut strip 65 of film 2 (this can also be seen in FIGS. 2 and 3). The offcut or trim strip 65 is formed immediately downstream of knife 50 and passes over the fourth roller 40 in order to follow a curved path into the mouth 66 of a trim collecting tube 64, the inlet mouth opening below the fourth cylinder 40. The trim collection tube 64 is normally subject to pneumatic suction but, in order to more readily draw off the strip of trim 65, the collection tube 64 is associated with a cutting knife 67 operating in the longitudinal sense which cuts the leading end of the offcut strip, enabling it to be readily introduced into tube 64 from whence it is readily drawn off and carried to a storage and recycling circuit after passing through a shredder fan or chopper common to all the trim collection tubes and which is not shown in the drawings.

With reference to FIG. 3, adjustable stops (stops 68 and 69 on linear guide 20, stops 69, 71 and 72 on the respective linear guides 20, 21, 22) are shown secured onto the linear guides of vertical plate 17 and these are designed to cooperate with a contact of an electrical and/or electronic switch means for stopping the drive motors which determine the movement of the two sliding carriers for each roll. In FIG. 3, the transmission mechanisms 73 and 74 for driving shafts 43 and 44 for linking and simultaneously driving respective pairs of sliding carriers **22*a*, 22*b* and 23*a*, 23*b* can be seen. The drive motors (not shown) for such mechanisms are, for example, flanged onto the gearboxes such as 43*a* and 44*a* in the example shown. FIG. 3 also shows a switch means 75 mounted on sliding carrier 23*a* which is designed to cooperate with stop 72 in order to bring to a shaft the motor that drives the sliding carriers 23*a* and 23*b* providing the horizontal movement of the fifth roller 41. By adjusting the position of the stops 68 to 72** on the linear guides or on the vertical plates, it is possible to establish an automatic stopping position of the sliding carriers for each roll.

Figure 7:
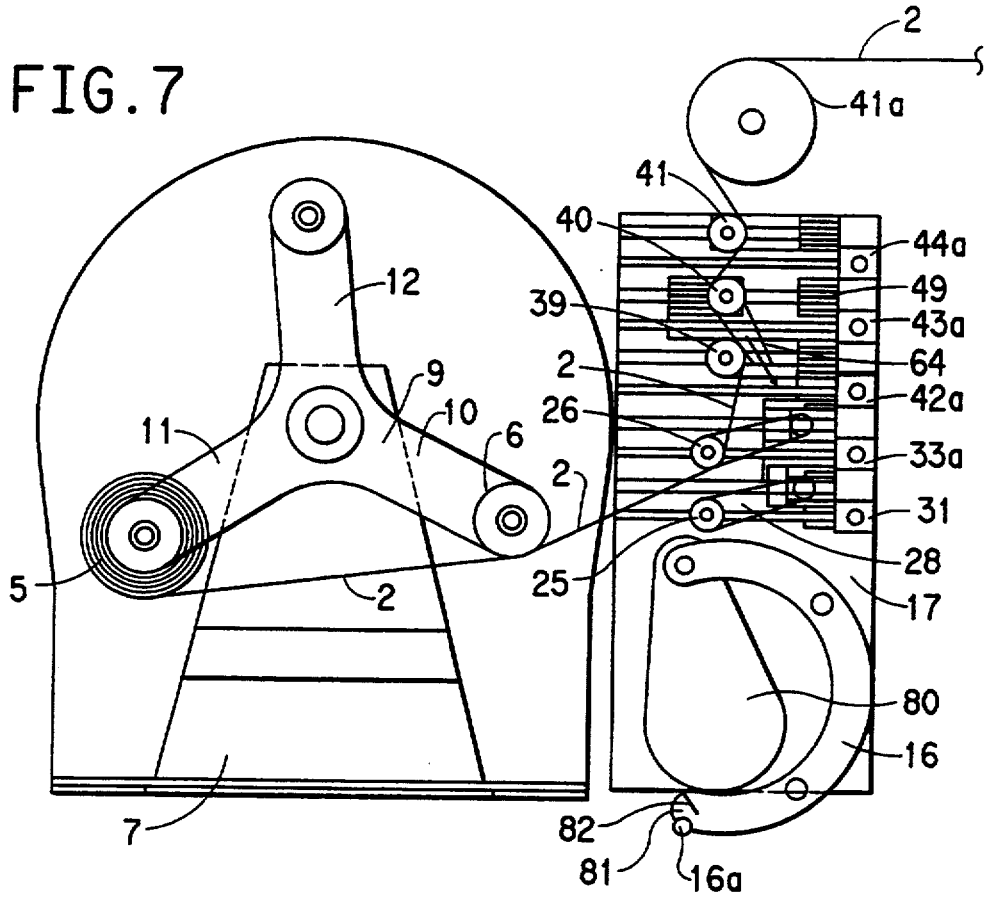
FIG. 7 shows in a schematic side view similar to FIG. 4 the winding apparatus of FIG. 1 with winding of one roll completed and the transfer rolls of the apparatus retracted to allow the turret to rotate and ready to wind a new core.

The operation of the film winding apparatus will now be described with reference to FIG. 1 which shows the apparatus in the production, in other words in the winding, position, to FIG. 4 which shows the apparatus into position where winding is about to start and with reference to FIGS. 7 and 8 which show the same apparatus respectively in a position where automatic changeover to winding another roll is occurring, and finally the apparatus at automatic restarting of winding on a new core.

Considering first FIG. 4 which also illustrates the thread-up operation, and comparing it with FIG. 1 showing the apparatus during normal production winding, sliding carriers **19*a* and 19*b* of the first roll 25 are moved by their respective drive motors to a withdrawn position in which the first roll, lay-on roll 25, is no longer in contact with the second roll, tracking roll 26, and with the outer surface of the core 6 of a roll to be wound, the arm 11 of the turret having rotated with respect to the position shown in FIG. 1. A wide passage 76 has thus been opened up between the first roll 25 and the second roll 26 the sliding carriers 20*a* and 20*b* of which have not moved. The piston of actuator 35 has now reached its stop position and rotation of the pivoting arms 29 and 30 has ceased in order to immobilize the second roll-26 in the position shown in FIG. 4. The sliding carriers 21*a* and 21*b* and 23*a* and 23*b* of the respective third and fifth rolls 39 and 40 are advanced by their drive motors (the drawings show motor 73 for the fifth roll 41) in order to adopt the position shown in FIG. 4 and to provide a clear passage 76** extending to the top of the apparatus.

A rigid film guide 78 which is movable in the vertical direction as illustrated in FIG. 4, and which is normally retracted during production, is then lowered to the position illustrated in FIG. 4 at which its discharge end is close to the rear outer surface of a previously mounted core 6, the passage 76 provided by retraction of roll I and advance of rolls 3 and 5 allowing the guide or thread-up tube 78 to pass without impediment. Closeness to the core, or to a partially-wound film surface, is preferably detected by proximity switch means which halt its downward movement. It can thus approach the core very closely. The apparatus is now in a position at which actual thread-up can start.

The leader 77 of film 2 is blown through the thread-up guide 78 by a blowing tube 79 and the leader 77 is caught by the core 6 which can be electrostatically charged if necessary. Other manners of attracting the leader to the core may be used such as introduction of fine droplets **77*a* of a liquid such as water in an air stream by means situated close to the core which are not illustrated, leading to the production of fine droplets on the surface of the film 2 which acts as a sort of adhesive between the core 6 and the film 2 or between two superposed layers of film 2**.

Figure 8:
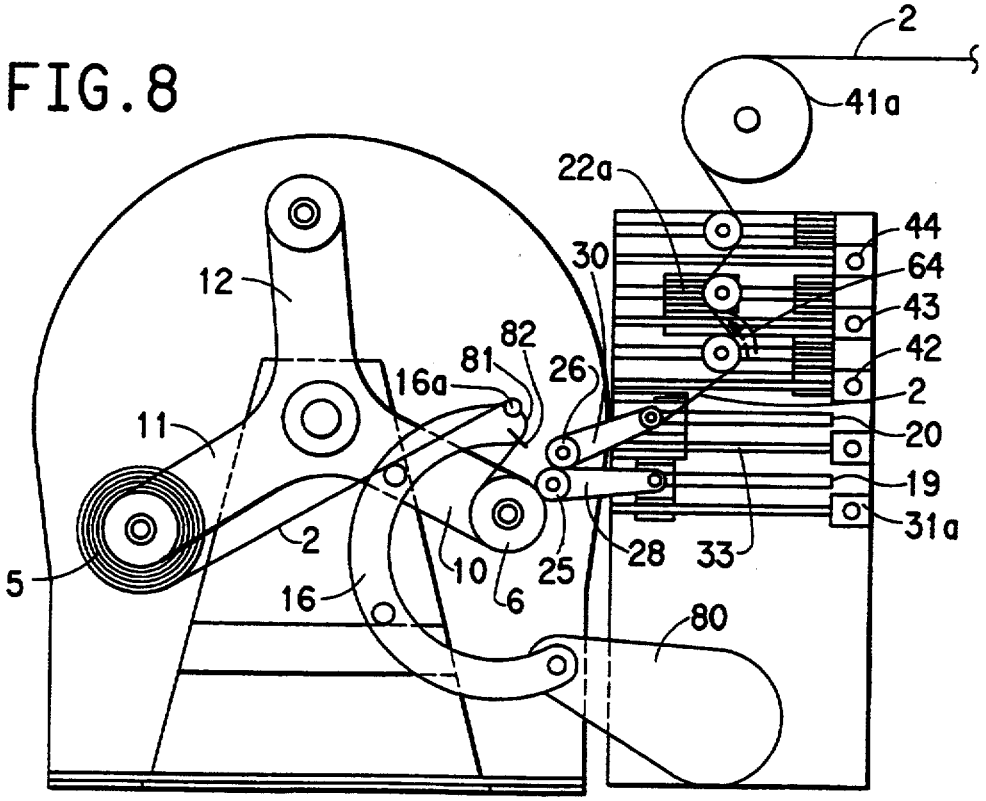
FIG. 8 shows the device of FIG. 7 at the instant when winding of a complete roll has been terminated and winding of a fresh core is starting.

When the leader 77 of film 2 has been caught by the core 6 to be wound, the rigid film guide or thread-up tube 78 is retracted and the film is laid onto the large diameter feed roll **41*a*, and the fifth and third rolls, 39 and 41, respectively, are retracted to their far rear positions by operating their respective motors while the first roll 25 is advanced to its forward position to adopt the positions for normal production running illustrated in FIG. 1 or rather in FIG. 8 because only the starting layer of film, and not a plurality of layers, has been wound onto core 6, and the pivoting arms 27–30 are in the lower position, as shown in FIG. 8. If the film is to be slit or edge trimmed, the slitting knifes 50 are advanced, possibly after winding of the film 2 onto the core 6 has started, to the position illustrated in FIG. 6**.

Production of a roll 5 now starts and the trims 65, if slitting is employed, are drawn off by the pneumatic tubes 64 and after being cut by knife 67 are passed to the common shredder fan as mentioned above. The rate of travel of the film 2 can reach 2 to 5 m per second. Edge slitting is generally applied and an extremely straight cut is achieved which, together with the dual tracking arrangement of the lay-on roll train 24 and the positioning of the first roll, lay-on roll 25, over more than 180° of the surface of which the film 2 passes, the film strip is applied onto the preceding layer without inclusion of air and a wound roll 5 is obtained in which lateral run-out cannot be distinguished by the naked eye, highly regular winding of roll 5 being thus obtained which is a significant improvement with regard to systems employed to date in which a further processing step is necessary to obtain the same result.

When wound roll 5 reaches its maximum required diameter, automatic changeover of winding onto another core 6 which has been previously mounted on arm 10 of the turret is ready to take place. To achieve this, the lay-on rolls 25 and 26 are fully retracted to the position shown in FIG. 7, and, with the film constantly maintained under tension, the rolls 39 and 41 of the feed and guiding train 24*a* are also retracted in order to allow the turret 9 to rotate. Immediately after all the rolls are retracted, the turret 9 rotates in order to bring the finished roll 5 (see FIG. 7) to a position where it is ready to be unloaded and an empty core 6 to a position where it is ready for winding. As illustrated in FIG. 7, the empty core 6 bears against the film 2 which is stretched between the finished roll 5 and the second lay-on roll 26 which is in its retracted position. The first lay-on roll 25 is no longer in contact with the strip of film 2.

The lay-on rolls 25 and 26 are then advanced to the position shown in FIG. 8 in order to apply the film 2 firmly against the core 6 and an enveloper roll 16*a* carried by arms 16, the side end of which can be seen at the free end 81 of arms 16, is advanced by the arcuate shaped arms 16 to the position illustrated in FIG. 8 by rotation of a cam-shaped drive member 80 and suitable guiding of its movement by means which are not illustrated. The film 2 is now applied to the empty core 6 over about 300° of its surface and adheres firmly to the surface of core 6. A transverse knife 82 provided at the end 81 of arms 16 makes a transverse cut through the strip of film 2 and the trailing end of the wound roll 5 can now be wound, for example, manually, onto this roll 5 which will be removed while winding is continuing on new core 6. The enveloping device 16 is then retracted by rotation of drive member 80 and roll production continues on the new core 6.

It should be noted that it is not necessary to withdraw the knifes 50 when changing production from one roll to another as the film 2 is effectively kept under tension during the whole roll changeover operation. The duration of this roll changeover operation is extremely brief thanks to the use of a software programmable logical controller which sequences the control and movements of all the elements of the apparatus, a number of failsafe devices ensuring that no operation can proceed before all participating components are in the correct position, while the tension in the film is permanently monitored and regulated.

The present invention is obviously not limited to the embodiments which have just been described and illustrated but may be subject to numerous variations accessible to those skilled in the art without this however leading to a departure from the scope of the invention. Thus, instead of only using two edge slitters 50 to obtain wound film rolls having a perfectly straight edge it would be possible to use at least an additional center sheet trim in order to produce two slit rolls during winding.

What is claimed is:

1. An apparatus for winding a continuous web of film material onto a core driven in rotation by a spindle and onto which said web of film is wound in order to form a cylindrical wound roll by means of a train of lay-on rolls for applying said web to said core, said train comprising first and second idling rolls arranged parallel to said core the first of said rolls being partially surrounded, during winding of said core, by said web and being disposed tangentially with respect to said second roll while firmly pressing said web against a surface of the second roll, and with respect to an outer surface of the wound roll to which said film is applied wherein, in the winding position, said first and second rolls are respectively applied to the outer surface of said wound roll being formed on said core and to said first roll by separate urging means located at each end of each roll and each urging means having a pivoting arm one end of which carries a bearing allowing rotation of a roll mounted therein and the other end of which pivots on a carriage movable along a guiding surface, said guiding surfaces of each of said rolls being parallel and the movements of the two carriages of a roll being synchronized by mechanical synchronization means linking said two carriages and web feeding and slitting rolls comprising a third roll providing transfer to said second lay-on roll, a fourth roll for tensioning said continuous web of film during cutting and a fifth roll for stabilizing and maintaining the web o film during cutting thereof, said third, fourth and fifth rolls being parallel to one another, in the production position of said apparatus, in a position where they are substantially vertically aligned one above the other and mutually spaced, said web of film being wound, prior to engaging said second lay-on roll, partially over said web-feeding rolls in alternate directions from one roll to the next.

2. An apparatus for winding a web of film according to claim 1 wherein each of said urging means acts on a pivoting arm for movement to a position of maximum angle of swing when said first or second rolls are not subject to the respective reaction forces respectively provided by said wound roll and by said first lay-on roll.

3. An apparatus for winding a web of film according to claim 1 wherein said urging means consist of a pneumatic cylinder having a piston movable therein, the rod of said piston pivoting on an extension of said pivoting arm while the end of said pneumatic cylinder remote from said rod pivots on the corresponding carriage.

4. An apparatus for winding a web of film according to claim 1, wherein in the position corresponding to thread-up or initiation of winding wherein carriages of said first cylinder are adapted to be displaced away from said cylindrical roll to a retracted position at which said first lay-on roll is no longer in contact with said second lay-on roll and with the outer surface of said cylindrical roll whereby a passage between said first and second lay-on rolls is created for allowing introduction of the leader of the film to be wound.

5. An apparatus for winding a web of film according to claim 4 wherein carriages of the second said lay-on roll are adapted to be held in position while their pivoting arms are caused to pivot to a position of maximum allowable swing by said urging means.

6. An apparatus for winding a web of film according to claim i wherein where said apparatus includes several cores each arranged on one of the arms of a rotatable turret means, the carriages of said first and said second lay-on rolls are adapted to move along their guiding surfaces to a retracted position remote from said wound roll to allow the arms, carrying a said wound roll or core, of said turret to rotate.

7. An apparatus for winding a web of film according to claim 1, wherein at least one knife means is applied to cut said web of film stretched between said fourth and fifth rolls.

8. An apparatus for winding a web of film according to claim 1 wherein the end bearings of the third, fourth and fifth rolls are each carried by a carriage movable along a substantially horizontal guiding surface arranged laterally with respect to said wound roll of film, the two carriages for each roll being synchronized by mechanical synchronizing means and being adapted to be movable, at least as regards said third and fifth rolls, from a position where they are advanced towards said wound roll of film to a retracted position.

9. An apparatus for winding a web of film according to claim 8, wherein in the position corresponding to thread-up or initiation of winding, the carriages of said third and fifth rolls are movable along their guiding surfaces in order to approach said wound roll to a fully-advanced position that provides a passage between said advanced third and fifth rolls, and said fourth roll, allowing introduction of the leader of the film to be wound.

10. An apparatus for winding a web of film according to claim 8, wherein the five said rolls comprising the two said lay-on rolls and the three said web-feeding rolls have substantially the same length and wherein the guiding surfaces for the carriages of said five rolls are supported by two parallel vertical plates arranged at a spacing substantially corresponding to the length of said rolls.

11. An apparatus for winding a web of film according to claim 10, wherein said two parallel vertical plates carry a beam arranged parallel to said rolls and at the same level as said fourth roll and at the opposite side thereto to said wound roll of film, said hollow beam carrying at the upper portion thereof a knife means mounted on a movable carrier the position of which can be adjusted both in the direction parallel to the axis of said beam and in the direction perpendicular thereto and wherein said knife means is applied to said film stretched between said fourth and fifth rolls in the region of said fifth roll.

12. An apparatus for winding a web of film according to claim 11, wherein said beam carries at least one tube for collecting the strip of trim cut from said continuous web of film by said knife means.

13. An apparatus for winding a web of film according to claim 12 wherein said trim collecting tube is carried substantially horizontally below said beam, said tube having an inlet for said trim in the form of a mouthpiece that opens below said fourth roll.

14. An apparatus for winding a web of film according to claim 12, wherein said tube includes means for cutting said trim after introduction thereof into said tube.

15. An apparatus for winding a web of film according to claim 8, wherein the extreme positions of the carriages of said third, fourth and fifth rolls on their respective guiding surfaces are manually adjustable by moving the position on the corresponding plate of a stop means cooperating with an electrical or electronic switch means for controlling a drive motor for providing synchronized displacement of the two carriages of each said roll.

16. An apparatus for winding a web of film according to claim 15, wherein mechanical synchronizing means for the two carriages of each of said third, fourth and fifth rolls include mechanical synchronization interrupting means adapted to enable the position one of said two carriages connected to said synchronizing means to be adjusted independently of the other.

17. An apparatus for winding a web of film according to claim 1, wherein the extreme positions of the carriages of said first and second rolls on their respective guiding surfaces are adjustable manually by moving the position of stop means cooperating with means for generating an electrical signal to control a drive motor for providing synchronized displacement of the two carriages of each said roll.

18. An apparatus for winding a web of film according to claim 17, wherein mechanical synchronizing means for the two carriages of each of said first and second rolls include mechanical synchronization interrupting means adapted to enable the position of one of said two carriages connected to said synchronizing means to be adjusted independently of the other which, for its part, remains synchronized.

19. An apparatus for winding a web of film according to claim 1, wherein said first roll is covered with an elastomeric material.

20. An apparatus for winding a web of film according to claim 1, wherein said second roll is a roll having a chrome plated finish.

21. An apparatus for winding a web of film according to claim 1, wherein said third, fourth and fifth rolls are in aluminum with a black anodized finish.

22. An apparatus of claim 1 wherein the movements of the two carriages of a roll are synchronized by mechanical synchronization.

23. A method for winding a continuous web of film material onto a core driven in rotation by a spindle and onto which said web is wound in order to constitute a cylindrical wound roll by means of a train of lay-on film application rolls consisting of first and second rolls pressing said web of film partially wound around said first roll respectively against the outer surface of said wound roll and against said first roll, wherein end bearings of the first and second rolls are mounted on a pivoting arm carried by a carriage movable on a guiding surface and the movements of the two carriages of each roll being synchronized, wherein each of said arms is acted on by individual urging means to cause pivoting thereof whereby said second roll is urged against said first roll in order to introduce said web onto said core with web feed and guiding rolls over which said web passes provided ahead of said lay-on film application rolls wherein each one of the end bearings of at least one of two alternate ones of said web feed and guiding rolls is mounted on a movable carriage moving linearly on a guiding surface in mechanical synchronization with the other of the two carriages of each of said rolls, said alternate individual rolls being displaced through moving of the carriages thereof on said guiding surfaces in order to bring them close to said wound roll of film and to open up a passage between said alternate rolls through which the leader end of a web to be wound in introduced and wherein, after the start of winding, said carriages are returned to their starting position in order to bring said web of film into contact with said feed and guiding rolls.

24. A method for winding a web of film according to claim 23, wherein with several cores being each arranged on one arm of a revolving turret, prior to rotation of said turret, the carriages of said first and second rolls are retracted on their guiding surfaces in order to move them away from said roll of film to provide a free passage for an arm loaded with a core or a wound roll of film of said turret.

* * * * *